US005916000A

United States Patent [19]

Feldmeier et al.

[11] Patent Number: 5,916,000

[45] Date of Patent: Jun. 29, 1999

[54] PRESS FIT ELECTRICAL CONTACT

[75] Inventors: Günter Feldmeier, Lorsch; Heinz-Peter Scherer, Bensheim; Fidelo Weigert, Dürrwangen, all of Germany

[73] Assignee: The Whitaker Corporation, Wilmington, Del.

[21] Appl. No.: 09/045,893

[22] Filed: Mar. 23, 1998

[30] Foreign Application Priority Data

Mar. 27, 1997 [DE] Germany ..... 197 13 152

[51] Int. Cl.[6] ..... H01R 13/42

[52] U.S. Cl. ..... 439/751

[58] Field of Search ..... 439/856, 857, 439/842, 816, 786, 751, 733.1, 82

[56] References Cited

U.S. PATENT DOCUMENTS

| | | | |
|---|---|---|---|
| 3,790,924 | 2/1974 | Sauer | 439/857 |
| 3,923,365 | 12/1975 | Lynch | 439/751 |
| 4,317,609 | 3/1982 | Lapraik | 439/733.1 |
| 5,060,372 | 10/1991 | Capp et al. | 29/883 |
| 5,067,916 | 11/1991 | Denlinger et al. | 439/857 |

FOREIGN PATENT DOCUMENTS

| | | | |
|---|---|---|---|
| 0 655 798-A2 | 5/1995 | European Pat. Off. | H01R 9/09 |
| 0 731 526-A2 | 9/1996 | European Pat. Off. | H01R 9/09 |
| 41 17 851-A1 | 12/1992 | Germany | H01R 9/09 |
| 2 127 625 | 4/1984 | United Kingdom | H01R 13/42 |

OTHER PUBLICATIONS

Copy of German Search Report.

*Primary Examiner*—Neil Abrams
*Assistant Examiner*—Michael C. Zarroli
*Attorney, Agent, or Firm*—Driscoll A. Nina

[57] ABSTRACT

An electrical contact element which is suitable for attaching and contacting in metallized bores, for example of a printed-circuit board, is specified; the contact element having a pressing-in region and a connection region, which adjoins the pressing-region via a transitional region; the pressing-in region comprising two layers of a metal sheet; the layers being arranged on each other symmetrically with respect to a plane between the layers, each of the layers having a slot formed between two contact limbs, the layers being curved away from each other, at least in the region of the slot, with the outer sides of the contact limbs diverging.

6 Claims, 4 Drawing Sheets

PRESS FIT ELECTRICAL CONTACT

BACKGROUND OF THE INVENTION

1. Field of the Invention

The invention relates to an electrical contact for mechanically attaching and electrically contacting with metallized bores, for example in printed-circuit boards.

2. Description of the Prior Art

Electrical contacts of this type include a pressing-in portion for pressing into the bore, which has a slot, formed like an eye-of-a-needle, between two contact limbs that engage the metallized bore.

EP 731 526 A2 discloses a pin-shaped contact having a pressing-in portion for pressing into the bore, which has a slot, formed like an eye-of-a-needle, between two contact limbs, and having a connection portion which adjoins the pressing-in portion via a transitional portion. In this document, a pin-shaped contact element is disclosed for contacting with plated through-holes of an electrical printed-circuit board. The contact includes a pressing-in portion, provided with a slot, and a connection portion connected to the said pressing-in portion. On each side of the slot are two resilient contact limbs which can be moved towards each other. The outer longitudinal sides of the contact limbs bear against the walls of the hole, with frictional forces being generated, into the hole when the contact element is pressed.

Depending on the requirements for an electrical contact, it may be that a thinner material should be used in the connection portion than is advisable in the pressing-in portion. To produce such a contact element, which usually takes place by stamping and forming a strip of sheet metal, strips of sheet metal which have different thicknesses are used. As a result, the production of such contacts becomes expensive.

SUMMARY OF THE INVENTION

It is the object of this invention to provide an electrical contact which includes thin material in the connection portion and can be produced in a simple manner.

The object is achieved by an electrical contact element comprising a pressing-in portion for pressing into the bore, the pressing-in portion having elastically deformable contact limbs with outer sides, and a connection region which adjoins the pressing-in region via a transitional region, the pressing-in region being formed by at least two layers of a metal sheet, which each have a slot, formed like an eye-of-a-needle, between two contact limbs, the layers being arranged upon each other symmetrically with respect to a plane between the layers and the layers in the region of the slot being close to each other in the center region and curved away from each other towards the outer sides.

It is known, when producing electrical contacts to provide more than one layer of a metal sheet at some points of the contact elements, for example by over-folding metal to produce double thickness electrical contact pins. Such a solution may also be sought for an electrical contact with a pressing-in portion and a connection portion if the connection portion is to be produced from a considerably thinner material than is advisable for the pressing-in portion. If the pressing-in portion is produced from two flat layers lying one on top of the other, with a slot like an eye-of-a-needle formed in each layer, there is the problem that, when introducing the pressing-in portion into a metallized bore, the layers of material lying on top of the other often flex apart. The force necessary for mechanical and electrical engagement, which is normally produced by the pressing together of the contact limbs on either side of the eye-of-the-needle, is not adequately applied, whereby poor contacting occurs.

The present invention is intended to overcome problems in the prior art. The two layers of metal sheet are arranged symmetrically upon each other and each layer has a convex curvature. The two layers are arranged in such a way that, in a cross-section viewed perpendicularly with respect to the pressing-in direction, the outer sides of the opposing surfaces of the two layers are spaced apart from each other, while the centres touch. When a pressing-in portion, formed in this manner, is pressed into a bore, the contact limbs on either side of the opening in each layer are then moved towards each other and consequently the slot is constricted. The elasticity of the limbs is not adversely impaired by the double-layered structure, but instead tends to be supported. Good contacting is ensured.

To avoid excessive cutting of the outer edges of the contact limbs into the metallization of the bores, it is advisable to round off the respectively outer edges, the edges which are not pointing towards the plane between the layers, of the contact limbs in each layer.

DETAILED DESCRIPTION OF THE PREFERRED EMBODIMENT

Figure 2:
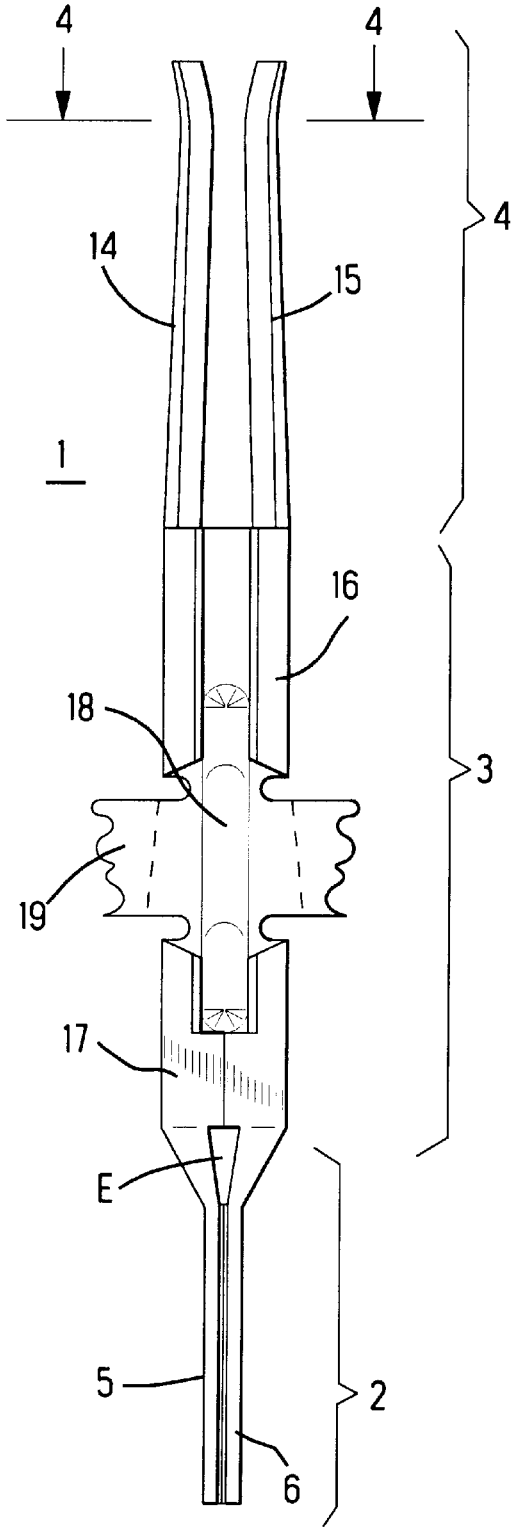
FIG. 2 shows a plan view of the electrical contact of FIG. 1.
Figure 1:
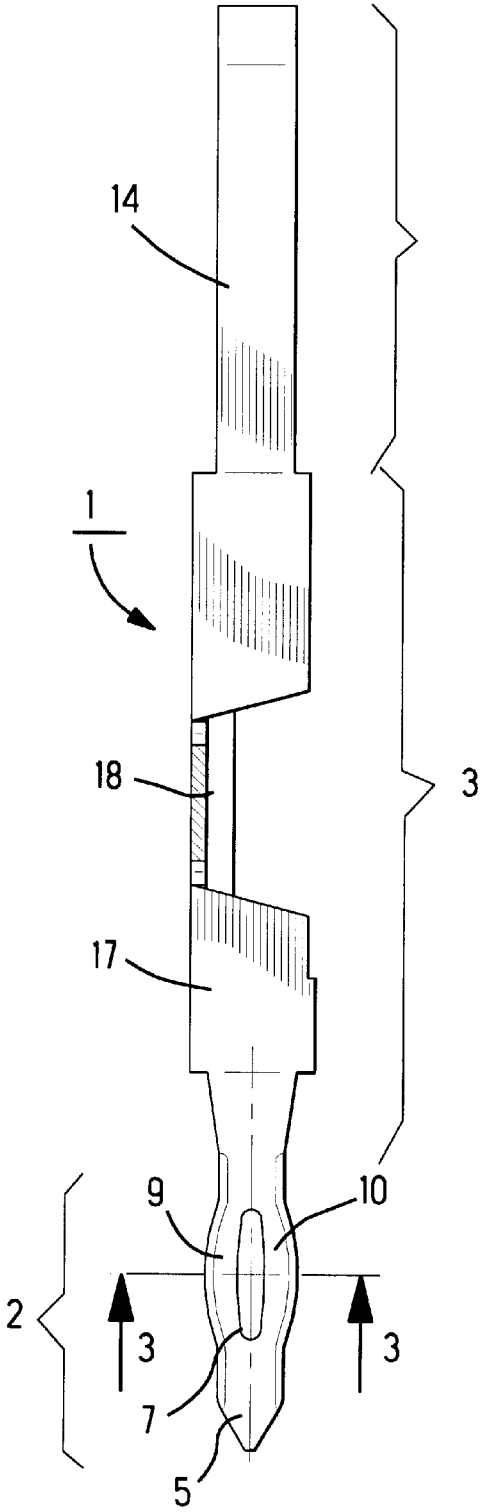
FIG. 1 shows a side view of an electrical contact incorporating the present invention.
Figure 6:
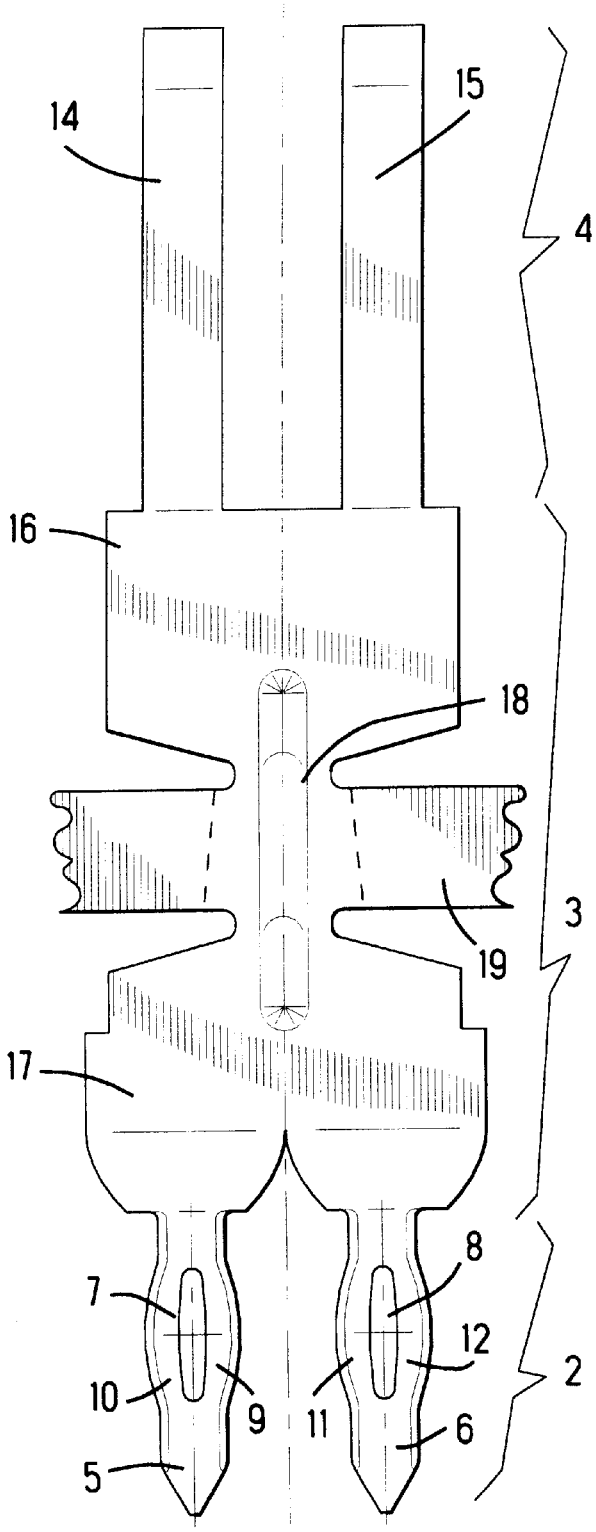
FIG. 6 shows a layout view of a blank used to form the electrical contact of FIG. 1.

In FIG. 1, an electrical contact 1 according to the invention is represented. The electrical contact 1 has a pressing-in portion 2, a transitional region 3 and a connection portion 4. The pressing-in portion 2 is formed by two layers 5, 6 (see FIG. 2) of sheet metal. Each of the layers 5, 6 has a slot 7, 8 formed like an eye-of-a-needle (see FIGS. 1 and 6). Each slot 7, 8 defines two contact limbs 9 to 12. The two layers 5, 6 are folded one on top of the other. They are arranged symmetrically with respect to a plane E between the two layers.

Figure 3:
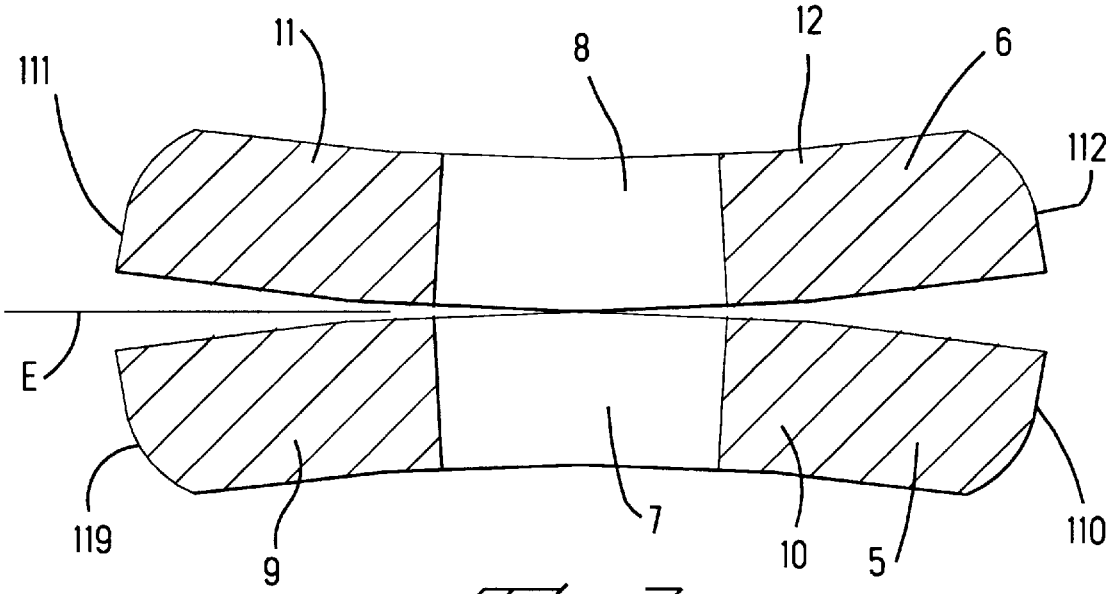
FIG. 3 shows a sectional view of the electrical contact taken along line 3—3 of FIG. 1.

As can be seen in FIG. 3 from the section along the line 3—3 through FIG. 1, the individual layers 5, 6 are of an oppositly facing convex design in the region of the slots 7, 8. The layers 5, 6 are arranged with respect to each other such that they touch in the central region and the outer sides 109 to 112 curve away from each other so that a gap exists therebetween.

Figure 8:
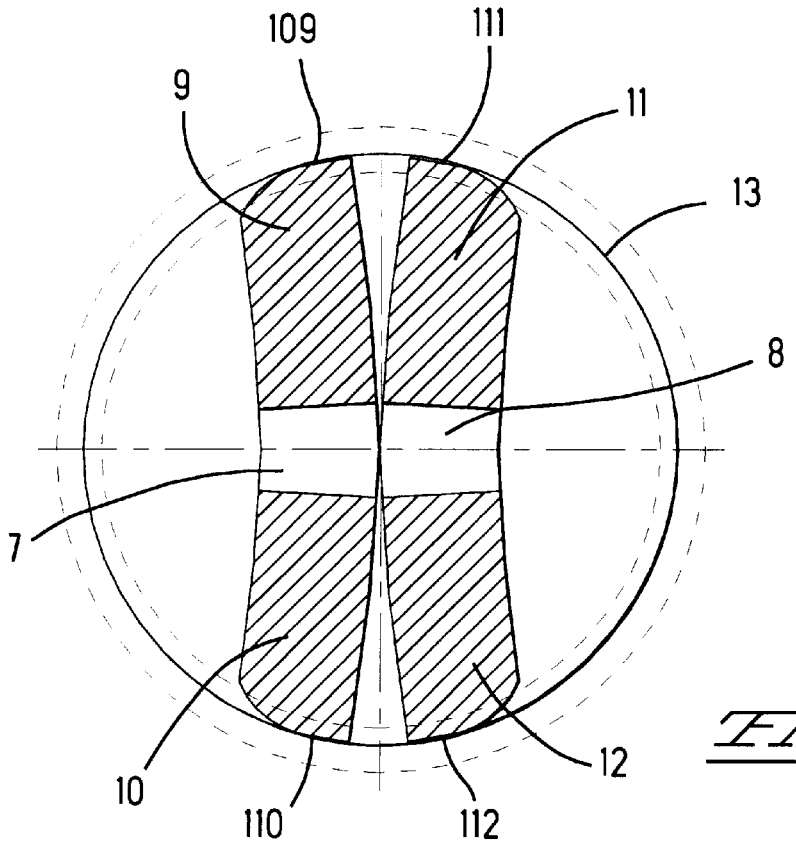
FIG. 8 shows a cross-sectional view corresponding to FIG. 7 after inserting the pressing-in portion into the bore.
Figure 7:
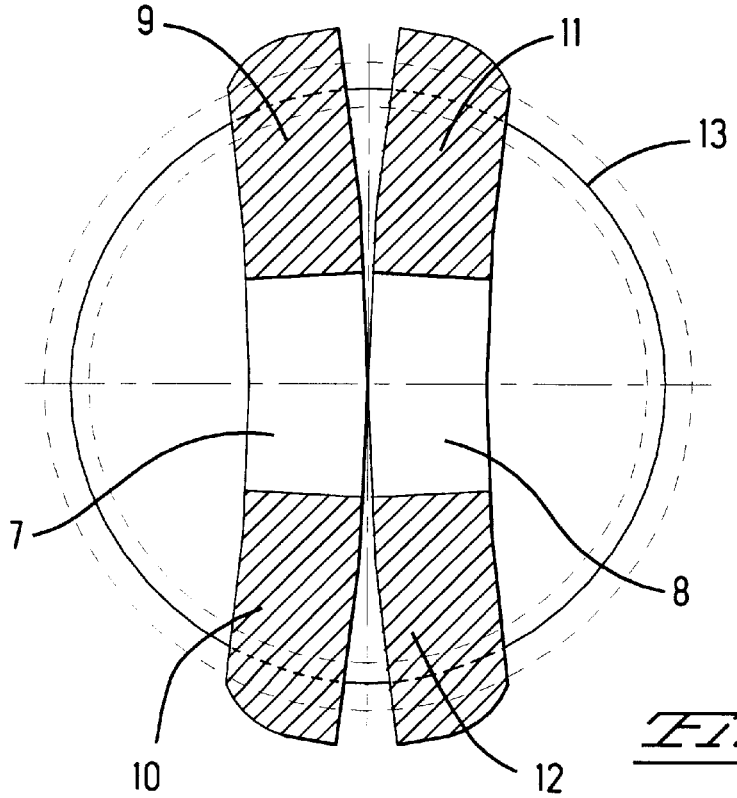
FIG. 7 shows a cross-sectional view along line 3—3 of FIG. 1 through the electrical contact which is located over a bore.

In FIGS. 7 and 8, the effect of inserting the pressing-in portion 2 in a metallized bore 13 is represented. FIG. 7, corresponding generally to FIG. 3, shows the pressing-in portion 2 over the bore 13 prior to being inserted therein. The slots 7 and 8 have their maximum width prior to insertion. The contact limbs 9 to 12 are of an elastic design. If the pressing-in portion is inserted in the bore, the contact limbs of each layer 9, 10; 11, 12, move towards each other thereby reducing the width of the slot 7, 8. The elastic deformation of the limbs 9, 10; 11, 12 has the effect of applying a contacting force, which reliably ensures the corresponding contact of sides 109–112 of the contact limbs 9–12 with the metallization of the bore 13.

Figure 4:
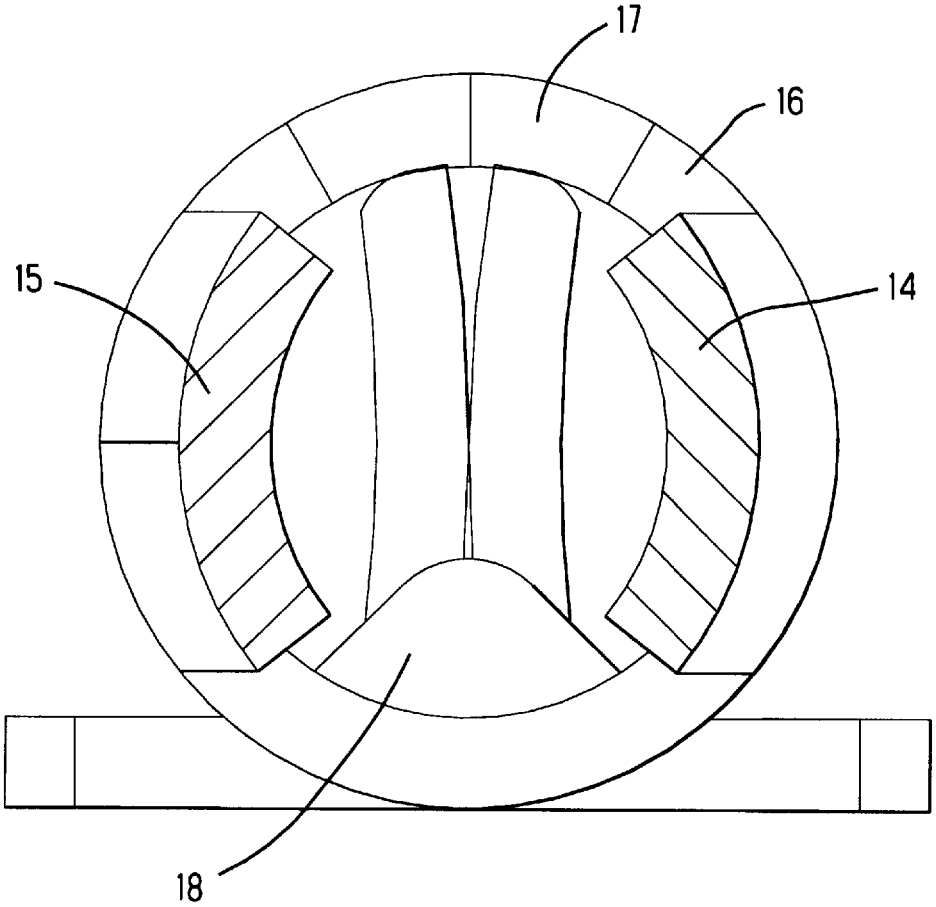
FIG. 4 shows a sectional view taken along the line 4—4 of FIG. 2.
Figure 5:
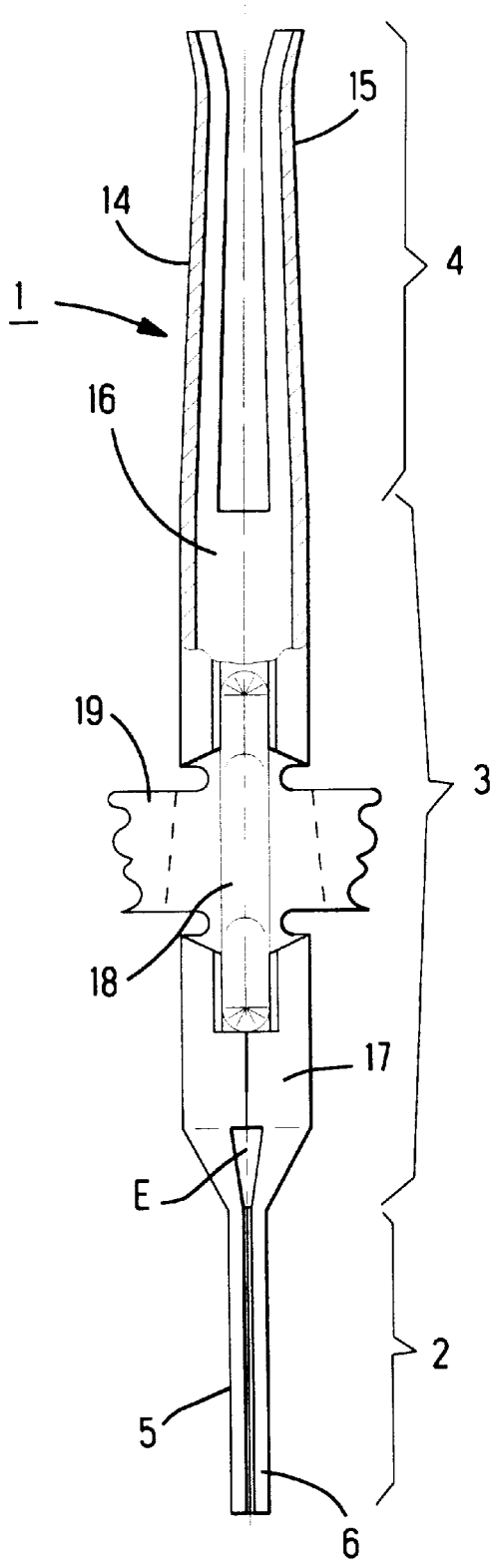
FIG. 5 shows a partially cut-away plan view of the electrical contact corresponding to FIG. 2.

The design of the transitional region 3 and of the connection portion 4 is described with reference to FIGS. 1, 2, 4, 5 and 6. In the cross-section along line 4–4 of FIG. 2, as represented in FIG. 4, it can be seen that the connection region 4 is of a substantially round design, with two opposing contacting arms 14, 15. The contacting arms 14, 15 are designed for contacting a round contact pin. The contacting arms 14, 15 are connected at one end to a base 16, which is part of the transitional region 3.

The pressing-in portion 2 is also connected to a corresponding base 17, which is likewise of a substantially round design. For stiffening the electrical contact 1 in the region in which a carrier strip 19 is provided, a corresponding deformation or convexity 18 is provided. The carrier strip 19 can be seen in FIGS. 2, 5 and 6.

We claim:

1. An electrical contact for insertion in metallized bores and making an electrical interconnection therewith, comprising a pressing-in portion for pressing into the bore, and a connection region which adjoins the pressing-in portion via a transitional region, the pressing-in portion being formed by two layers of a metal sheet, that each have two contact limbs with outer sides, a central region between the outer sides and a slot located between the two contact limbs, the layers being arranged upon each other symmetrically with respect to a plane between the layers and the layers being curved in the region of the slot such that they are adjacently disposed in the central regions and corresponding outer sides of the contact limbs diverge from each other.

2. The electrical contact according to claim 1, wherein the contact limbs have outer edges pointing away from the plane between the layers where these outer edges are rounded.

3. The electrical contact according to claim 1, wherein the contact is produced by stamping and forming from sheet metal.

4. An electrical contact for forming an electrical interconnection with a metallized bore, the electrical contact comprising a connection portion for engaging a complementary conductor and a pressing-in portion to be received in the metallized bore and become electrically engaged therewith, the connection portion and the pressing-in portion being connected through a transitional region, where the pressing-in portion includes two overlying layers with each layer having two opposing contact limbs for being press-fit into the metallized bore where each layer has a curved surface, the curved surface of one layer facing opposite the corresponding curved surface of the other layer, and where each layer further has a central region and outer sides and the curved surfaces are formed such as they are close to one another in the central region and are separated further at the outer sides.

5. The electrical contact according to claim 4, wherein the contact limbs have outer edges pointing away from the plane between the layers where these outer edges are rounded.

6. The electrical contact according to claim 4, wherein the contact is produced by stamping and forming from sheet metal.

* * * * *